US007121336B2

(12) United States Patent
Hatley

(10) Patent No.: US 7,121,336 B2
(45) Date of Patent: Oct. 17, 2006

(54) WELL SCRUBBER

(75) Inventor: Jerry W. Hatley, Lubbock, TX (US)

(73) Assignee: McGinnis Chemical, Inc, Lubbock, TX (US)

( * ) Notice: Subject to any disclaimer, the term of this patent is extended or adjusted under 35 U.S.C. 154(b) by 608 days.

(21) Appl. No.: 10/358,886

(22) Filed: Feb. 5, 2003

(65) Prior Publication Data

US 2004/0089323 A1 May 13, 2004

Related U.S. Application Data

(60) Provisional application No. 60/425,405, filed on Nov. 11, 2002.

(51) Int. Cl.
*E21B 37/00* (2006.01)

(52) U.S. Cl. ..... 166/170; 15/104.2

(58) Field of Classification Search ..... 166/170, 166/171; 15/104.2

See application file for complete search history.

(56) References Cited

U.S. PATENT DOCUMENTS 354,478 A 12/1886 Kear ..... 15/104.16
1,677,050 A 7/1928 Reed et al. ..... 15/104.19
1,837,931 A 12/1931 Walbrohl ..... 15/104.067
2,296,514 A * 9/1942 Gibson ..... 166/171
2,415,729 A 2/1947 Dana ..... 15/104.05
3,178,771 A 4/1965 Claiborne et al. ..... 15/104.16
3,460,180 A 8/1969 Girard ..... 15/104.19
3,952,359 A 4/1976 Rosseau ..... 15/182
5,030,291 A 7/1991 Titmas ..... 15/104.5
6,775,872 B1 * 8/2004 Appleton et al. ..... 166/170

* cited by examiner

*Primary Examiner*—David Bagnell
*Assistant Examiner*—Matthew J. Smith
(74) *Attorney, Agent, or Firm*—Conley Rose, P.C.

(57) ABSTRACT

A cylindrical brush for scrubbing the inside surface of a pipe is made of bristles attached to a springy helix. The diameter of the brush is greater than the inside diameter of the pipe. When the brush is pushed through the pipe the helix collapses and compacts the bristles to scrub the surface. When the brush is released in the pipe, the helix expands and spreads the bristles; thereby aiding in release of debris collected on the bristles during the scrubbing.

6 Claims, 4 Drawing Sheets

WELL SCRUBBER

CROSS REFERENCE FOR RELATED APPLICATION

Applicant claims benefit of a provisional application filed on Nov. 11, 2002, Serial No. 60/425,405. Specific references to this document is requested.

BACKGROUND OF THE INVENTION

This invention relates to cleaning the inside surface of pipes. Although this invention is useful for other pipes, it is primarily designed for scrubbing the pipe of agriculture irrigation wells. Debris often attaches to the inside diameter of the pipe. Even if the pipe bore is not reduced substantially, the rough surface of the pipe hinders the free flow of water, therefore requiring extra power of the pumps to force the water to the surface of the ground.

Previously, tools for cleaning pipes have been patented. For example, Kear U.S. Pat. No. 354,78, Dec. 14, 1886, describes a device for cleaning water pipes. Reed, et al; U.S. Pat. No. 1,677,050, Jul. 10, 1928 shows a device called a parafant cutter which has helical rods which bow outwards to clean the pipes. Walbrohl U.S. Pat. No. 1,837,931, Dec. 22, 1931 shows a brush of steel wires which are positioned around a cylinder and are separated by helical springs.

Dana U.S. Pat. No. 2,415,729 , Feb. 11, 1947 discloses a series of brushes for the cleaning of oil wells. Dana, like Walbrohl, discloses the brush as held by a line to the top of the well and is pulled downward by a weight attached to the bottom of the brush structure. Claiborne, U.S. Pat. No. 3,176,771 scrapes mud-cake from the side of a bore. Girard, U.S. Pat. No. 3,460,180, Aug. 12, 1969 discloses a scrapper for scraping the inside of pipes. Rosseau, U.S. Pat. No. 3,952,359, Apr. 27, 1976 shows a street sweeper brush which holds the bristle to an inside metal U-shaped holder which is similar to the holding of the brushes of this application.

BRIEF DESCRIPTION OF THE DRAWINGS

Bristles of cylindrical brushes are clustered together to scrub debris from the interior surface of a pipe. With the bristles clustered together, the bristles become loaded with debris. The loaded bristles are loosened and scattered to permit the debris to drop from the scattered bristles, as desired by the operator.

DESCRIPTION OF THE DRAWINGS

Figure 1:
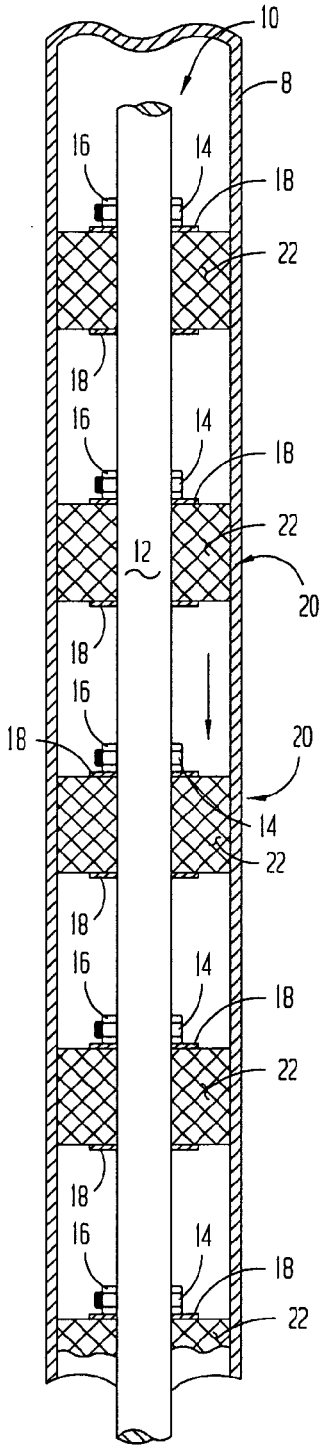

FIG. 1 is an incomplete cross section of the scrub unit in a vertical pipe with the brushes in the condition they would be in when the unit was moving downward within the pipe.

Figure 2:
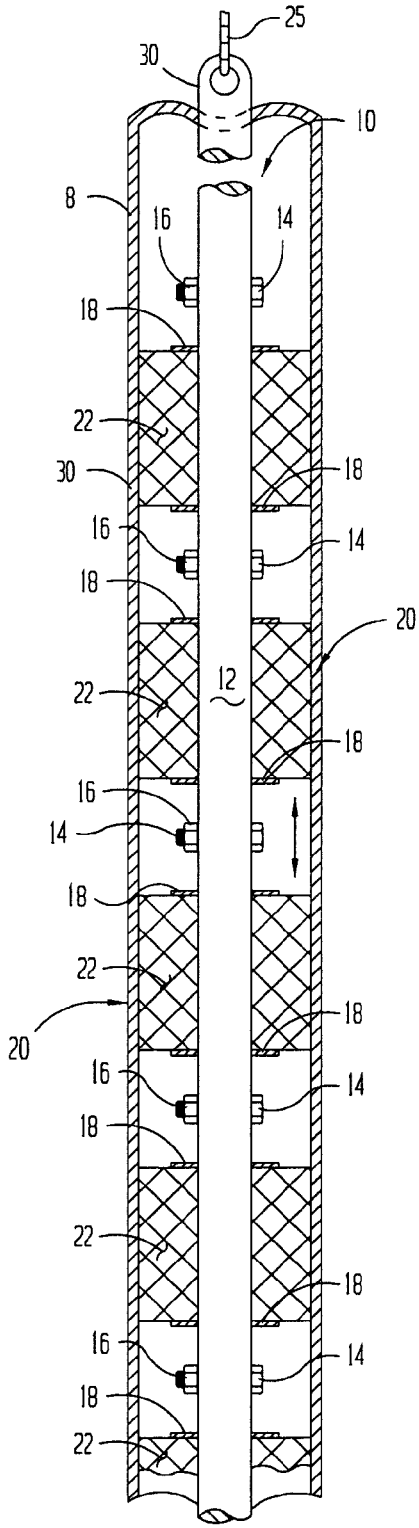
Figure 3:
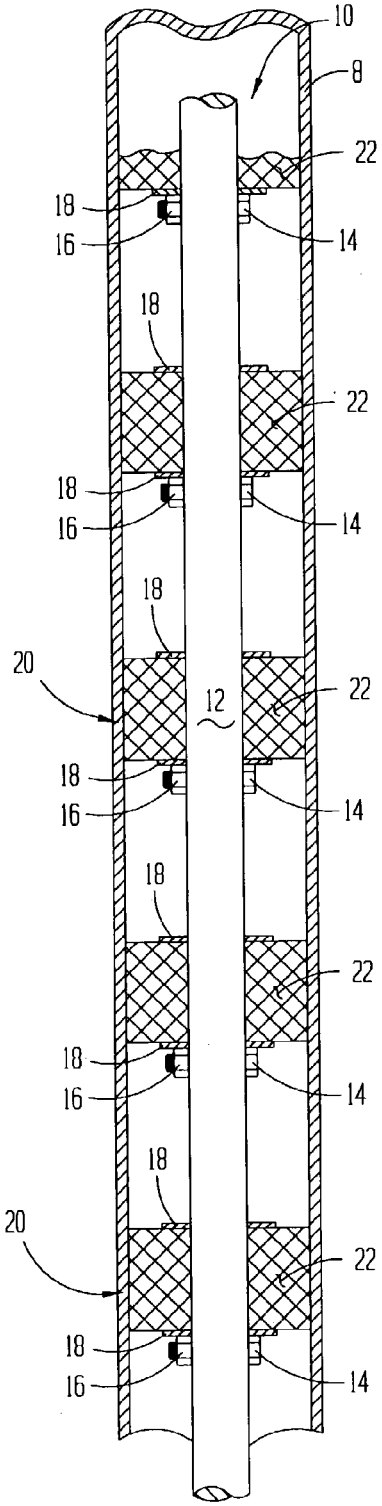

FIG. 2 is an incomplete sectional view illustrating the conditions of the scrub unit when the unit was not being forced upward or downward and therefore the brushes are expanded to a spread condition where the bristles are spaced wider apart than when in the scrub position such as shown in FIGS. 1 and 3.

FIG. 3 shows the condition of the scrub unit as the system was moving upward by pulling the suspending cable upward.

FIGS. 1, 2 and three do not show the channel with the bristles attached.

Figure 4:
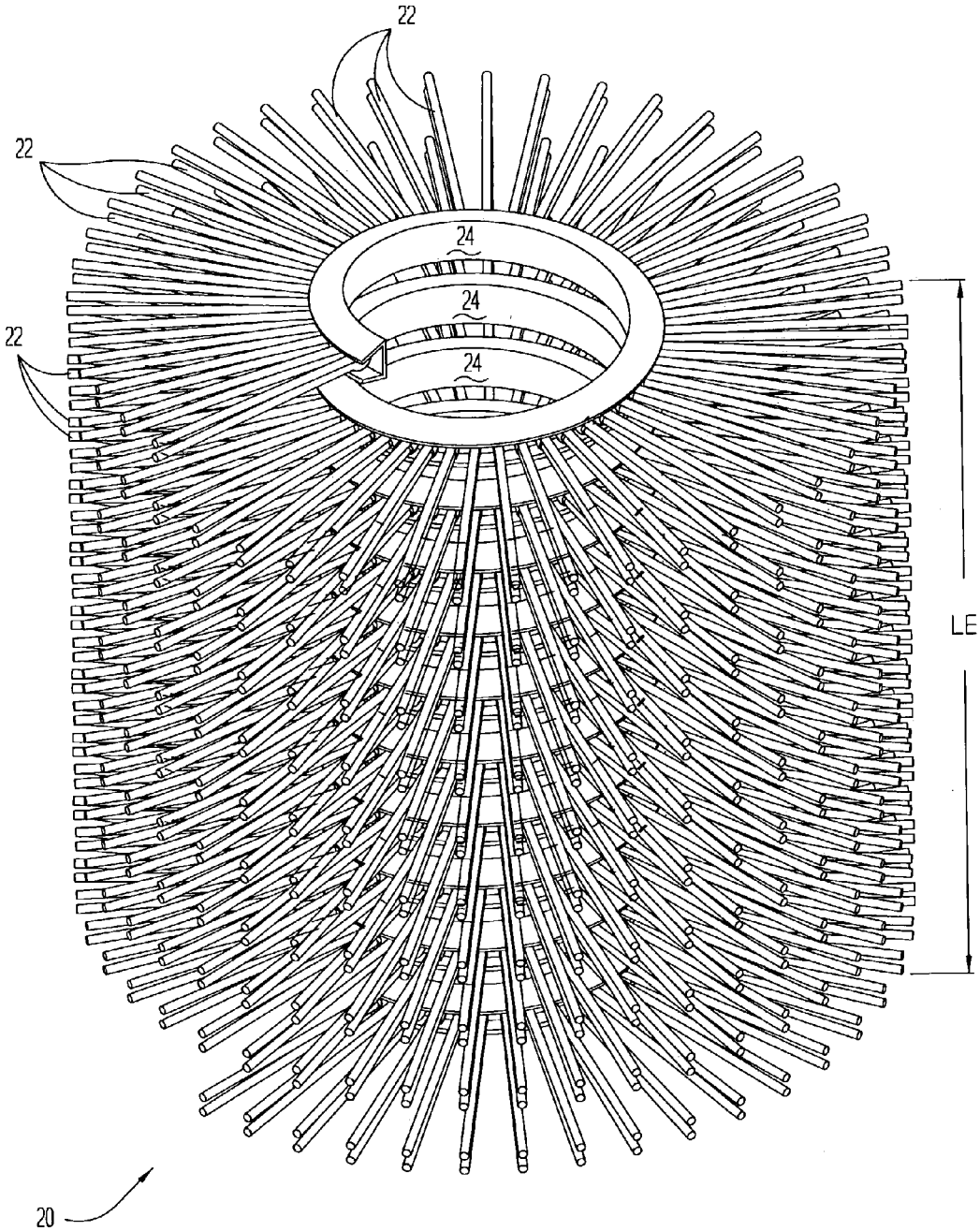

FIG. 4 is a illustration of a brush dissembled from the rod showing the spacing of the channel loops when there is no external pressure.

Figure 5:
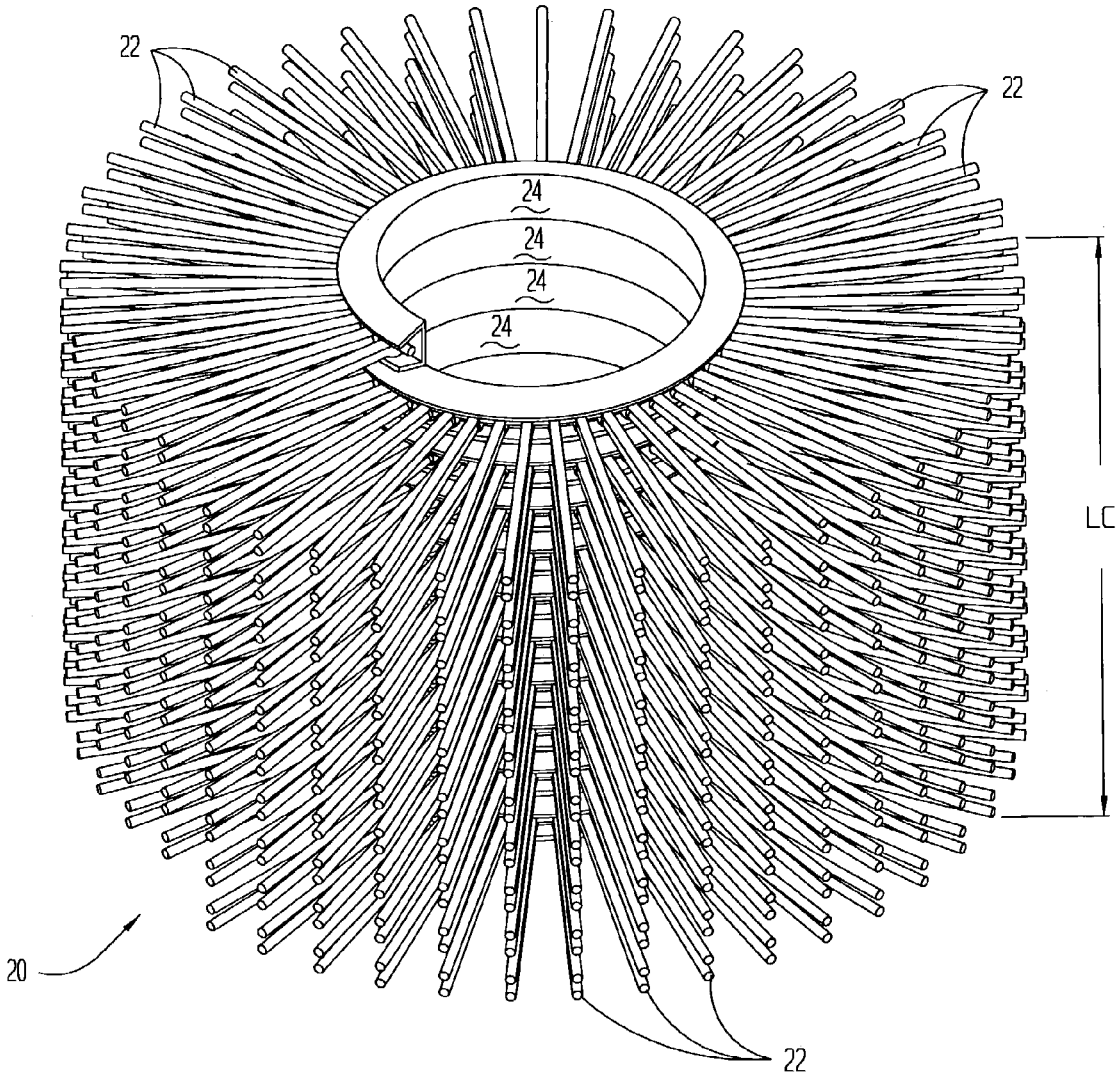

FIG. 5 is similar to FIG. 4 showing a brush in the fully collapsed position with each channel loop in contact with the adjacent loop.

Figure 6:
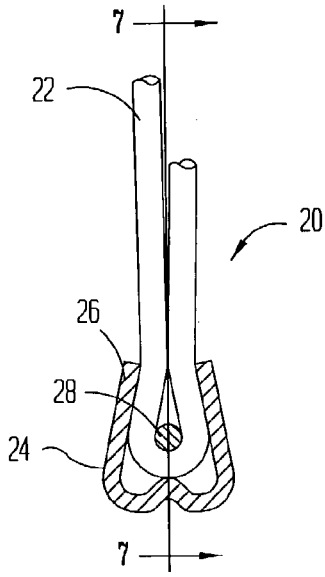

FIG. 6 is a cross section of the channel showing the clamping of the bristles within the holder and the position of a wire in this part.

Figure 7:
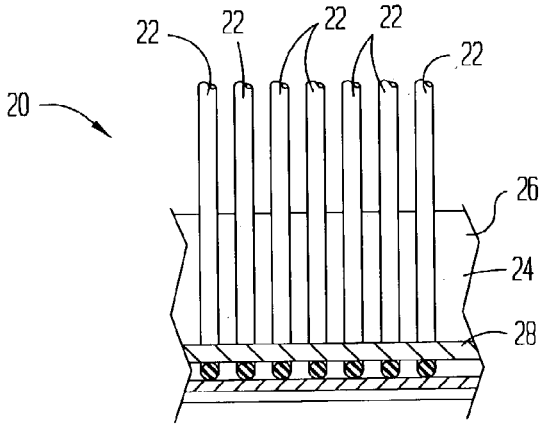

FIG. 7 is a section of a view taken on line 7—7 of FIG. 6.

CATALOG OF ELEMENTS

As an aid to correlating the terms to the exemplary drawing(s), the following catalog of elements is provided:

| | |
|---|---|
| 8 | pipe |
| 10 | scrub unit |
| 12 | rod |
| 14 | bolt |
| 16 | nut |
| 18 | washer |
| 20 | brush |
| 22 | bristles |
| 24 | channel |
| 25 | cable |
| 26 | metal |
| 28 | wire |
| 30 | eye |
| LE | Axial length extended |
| LC | Axial length compacted |

DESCRIPTION OF THE PREFERRED EMBODIMENT

A scrub unit 10 includes rod 12 and one or more brushes 20.

The scrub unit 10 is shown in FIG. 1 as it would appear after going into the well where the scrub unit 10 is moving downward by the weight of rod 12. Individual brushes 20 are carried upon rod 12. Rod 12 is preferably an iron rod about 2' in diameter when the scrubber is to be used for a 6' pipe. For one scrub unit 10 there would be a total of about three to five brushes 20. The top of the rod has an eye 30 for attaching cable 25. The bottom of the rod 12 is threaded so that an additional metal rod could be attached to the bottom of the rod 12. The additional rod could carry either brushes as does rod 12, or it could be without brushes merely to give additional weight to the unit if such was required by the operator. A series of bolts 14 extend through the rod 12 and held by nuts 16 to keep the brushes 20 within a certain limit of travel up and down the rod. Bristles 22 on each brush 20 are in contact with the inner surface of pipe 8. As the rod moves downward, each of the brushes 20 against the inner surface of the pipe 8 will cause washer 18 on the rod above the brush to move against the bolt 14 above the brush. The friction of the bristles on the brush will cause the brush to retract into a shorter compact length when moving vertically. The contacted bristles will efficiently scrub the interior of the pipe 8.

FIG. 5 is a representation of the compacted brush 20 when the vertical movement causes each channel 24 loop to contact the adjacent channel 24 loop. This causes bristles 22 to bunch or cluster or move together. This cluster of bristles scrubs the pipe better than separated bristles.

After the scrub unit 10 has moved down a desired amount the rod 12 may be moved upward by cable 25 pulling it upward. As seen in FIG. 2, at this time of transition when the rod 12 first begins moving upward, the natural spring of the U-shaped metal channel 24 will tend to elongate, thus spreading the individual coils of the brush 20. FIG. 4 is a representation of the relaxed brush 20 when the reversed movement causes each channel 24 loop to spread away from the adjacent channel 24 loop. This causes the bristles 22 to scatter or move away from the other bristles. This scattering of the bristles 22 aids in releasing debris, thus preventing the bristles from becoming loaded with debris. At this time much of the debris that was attached to the bristle 22 of the scrubber unit 20 will come free.

With continued upward movement of rod 12 by reeling in the cable 28 it will be understood that each brush 20 would assume the position as shown in FIG. 3; the brushes 20 would compact until the channels 24 were in contact bringing all the bristles 22 together as they scrubbed in the upward phase.

Although not critical, the expansion of the brush is about twice the axial length of the scrubber fully compressed. For example, one scrubber has a length extended of 5½ inches and length compacted of 3 inches.

The bolts 14 that extend through diametric holes in rod 12 are held in place by nuts 16. The washer 18 as placed on the rod has an inside diameter of slightly more than the diameter of the 2" rod, and an outside diameter of 3½ inches. One of the brushes 20 is placed on top of the washer 18. A top washer 18 is placed above the brush. Another bolt 14 is attached with nut 16 to the rod 12.

Brush 20 includes a helical metal spiral channel 24 of about 6 inches from top to bottom. The brush 20 has a diameter of slightly more than 6 inches to operate in a 6" pipe.

The brush 20 has bristles 22 attached to the helical metal channel 24. The channel is a springy coil having about eleven loops.

Each brush 20 when relaxed will have an axial extended length of about 6 inches. When a brush 20 is compressed with all eleven loops of channel 24 contacting the adjacent loop, it will have an axial compressed length of about 3½ inches. When the brushes 20 are on the rod 10 outside the pipe, they will have approximately three inch movement between the limiting bolts 14. Referring to FIG. 4, which shows a brush 20 in the relaxed position, the channels 24 are formed in the helical spiral position and therefore have the loops of the spiral are separated. Also, there would be approximately 11 loops in the brush 20. When they are pressed together, as seen in FIG. 5, the channels 24 would be adjacent and therefore the axial length of the brush is about 3½ inches.

Polypropylene bristles 22 are attached within the channel 24. The diameter of the brusher is over 6 inches so that when it is cleaning the pipe the bristles have pressure contact with the walls of the pipe.

Referring to FIG. 1, showing the scrub unit 10 as it moves downward, the tips of the bristles 22 are pressured against the inside surface of the pipe 8, which is rough with debris. This drags the brushes 20 along the pipe inside surface as the weight of the rod 12 force the brushes down. The weight of the rod 12 will push the washer 18 by the bolts 14 and nut 16. The continued downward pressure of the weight of rod 12 will result in the compression of the brush 20 and the concentration of the bristles 22. The continued downward movement scrubs the inside surface of the pipe 8.

When the unit 10 is moved upward by the cable 28 attached to the eye 30, the brushes would no longer have the weight of the rod against them, and therefore, they would expand. The spring resilience of the channels 24 would cause the brushes to expand. When the channels 24 are expanded it will aid in the removal of the debris from the bristles 22. Referring to FIG. 3, it may be seen that as the unit is pulled upward as shown by the 'U' arrow, that the brushes 20 would be compressed by the friction on the inside pipe surface so that the brushes 20 would be pushed upward by the washer 18 because of the upward movement of the bolts 14.

Therefore, it may be seen that by moving the rod 12 by the supporting cable 28 unit for a few feet upward and then permitting it to lower a few feet downward would scrub the inside surfaces of the pipe. Also, as it alternates between upward movement and downward movement there would be a repeated dispersing of debris from the bristles.

The bristles 22 and their attachment in channel 24 is shown in FIG. 6 and 7. The attachment is formed with bristles made from crimped red polypropylene stock measuring 0.8 mm thick×1.05 mm wide. The bristles 22 are looped around wire 25. The wire with the bristles are clamped into the channel 24. The channel 24 and the wire 25 are resilient. Since they are resilient they will tend to be a helix as illustrated in FIG. 4. This is to say unless an exterior force is put upon them the helical spiral of the channel will cause the brush 20 to be an extended axial length. However, when they are subject to an external force exerted along the axis of the helix they would be reduced into a compressed axial length. However, as stated when the external pressure is releases, the brushes expand into the extended axial length.

It will be understood that the embodiment of the invention as described here would be subject to many variations. Specifically, the rod 12 could be of various diameter and lengths depending upon the inside diameter of the pipe for which it would clean. Also, additional weights could be attached to the bottom of the rod. Also the rod could be suspended by a cable or could be suspended by tubing. In certain circumstances, two or more of the cleaning units 10 could be fastened together if this was the desire of the operator. Also, even if the rod 12 were designed to hold four brushes 20 it would be understood that it could be operated with one or two or three brushes as well as the full four brushes.

The embodiment shown and described above is only exemplary. I do not claim to have invented all parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific example above do not point out what an infringement of this patent would be, but are to enable the reader to make and use the invention.

The invention claimed is:

1. A scrubber having an elongated rod and at least one cylindrical coiled brush, a) the brush having a relaxed length and a compact length, b) the brush including a helical springy metallic channel, c) the channel is loosely coiled around the rod; thereby permitting the channel to rotate around the rod and also move longitudinally along the rod, d) the brush also including a plurality of bristles attached to the channel and which extend radially from the channel, e) projections spaced along the rod, f) the projections extend from the rod a sufficient distance to prevent the coiled channel from moving across a projection, and g) the projections are spaced apart a greater distance than the relaxed length of the brush.

2. The invention described in claim 1 further including:

h) the scrubber is within a cylindrical pipe having an uniform diameter, and i) the diameter of the bristles on the brush of the scrubber is greater than the inside diameter of the pipe.

3. The invention described in claim 2 further including:

j) the cylindrical pipe and the rod are co-axially and are vertical, k) the rod is suspended by a line extending to a top of the circular pipe, and l) the weight of the rod is sufficient to move the scrubber downward.

4. The invention as described in claim 3 further including: m) the scrubber has a plurality of brushes on the rod as described.

5. The invention above described in claim 3, further including: m) the pipe has ports in it.

6. A scrubber having an elongated rod and at least one cylindrical coiled brush, a) the brush having a relaxed length and a compact length, b) the brush including a helical springy metallic channel, c) the channel is loosely coiled around the rod; thereby permitting the channel to rotate around the rod and also move longitudinally along the rod, d) the brush also including a plurality of bristles attached to the channel and which extend radially from the channel, e) projections spaced along the rod, f) the projections extend from the rod a sufficient distance to prevent the coiled channel from moving across a projection, g) the projections are spaced apart a greater distance than the relaxed length of the brush;

h) the scrubber is within a cylindrical pipe having an uniform diameter, i) the diameter of the bristles on the brush of the scrubber is greater than the inside diameter of the pipe;

i) the cylindrical pipe and the rod are co-axially and are vertical, k) the rod is suspended by a line extending to a top of the circular pipe, l) the weight of the rod is sufficient to move the scrubber downward;

m) a washer around the rod between each of a top of the brush and a projection, and n) a washer around the rod between each of a bottom of the brush and a projection.

* * * * *